US006474645B2

(12) United States Patent
Tarantino

(10) Patent No.: US 6,474,645 B2
(45) Date of Patent: Nov. 5, 2002

(54) MULTI-HAND POKER GAME

(75) Inventor: Elia Rocco Tarantino, Las Vegas, NV (US)

(73) Assignee: Colepat, LLC, North Las Vegas, NV (US)

( * ) Notice: Subject to any disclaimer, the term of this patent is extended or adjusted under 35 U.S.C. 154(b) by 0 days.

(21) Appl. No.: 09/802,515

(22) Filed: Mar. 8, 2001

(65) Prior Publication Data

US 2002/0135128 A1 Sep. 26, 2002

(51) Int. Cl.[7] ..... A63F 1/00
(52) U.S. Cl. ..... 273/274; 463/13
(58) Field of Search ..... 273/274, 292, 273/138.1, 139, 303; 463/11–13

(56) References Cited

U.S. PATENT DOCUMENTS 5,531,448 A 7/1996 Moody
5,732,950 A 3/1998 Moody
5,816,916 A 10/1998 Moody
5,823,873 A 10/1998 Moody
5,976,016 A 11/1999 Moody et al.
6,007,066 A 12/1999 Moody
6,050,568 A * 4/2000 Hachquet ..... 273/292
6,098,985 A 8/2000 Moody
6,120,378 A 9/2000 Moody et al.
6,248,016 B1 * 6/2001 Walker et al. ..... 273/293
6,270,405 B1 * 8/2001 Ferguson ..... 273/138.1

* cited by examiner

*Primary Examiner*—Benjamin H. Layno
*Assistant Examiner*—V K Mendiratta
(74) *Attorney, Agent, or Firm*—Weide & Miller, Ltd.

(57) ABSTRACT

A multi-hand poker game is disclosed. In one embodiment, the game includes the steps of dealing a first hand of a predetermined plurality of cards, selecting cards from the first hand to be duplicated into a second hand, selecting cards to be held from the first hand, discarding cards from the first hand which are not held, replacing the discarded cards in the first hand to complete the first hand, adding cards to the second hand to complete the second hand of a predetermined plurality of cards, and determining if the first or second hands comprise a predetermined combination of winning cards. In one embodiment, none, one or more or all of the cards of the first hand may be duplicated in to the second hand, and none, one or more or all of the cards in the first hand may be held. The cards which are duplicated and the cards which are held may be different. In one embodiment, additional hands of cards may be played, with the player allowed to select none, one or more, or all of the cards from the first hand to be duplicated into those hands. In one embodiment, the game may be implemented on a computing device and a computer may select the cards to be duplicated and the cards to be held. In one embodiment, a player is required to place a wager for each hand played. In another embodiment, the player is permitted to play a plurality of hand based on a single wager.

18 Claims, 2 Drawing Sheets

MULTI-HAND POKER GAME

FIELD OF THE INVENTION

The present invention relates to card games, and more particularly to poker-type card games.

BACKGROUND OF THE INVENTION

Poker is a popular card game which has many variations of play. As is known, the game of poker has been adapted for play on electronic gaming devices commonly referred to as "video poker machines." In the game of video poker, a player attempts to obtain a hand of cards which comprise one or more predetermined winning card combinations. For example, the winning card combinations may comprise a pair of Jacks or better. The player attempts to obtain a hand including cards of at least a pair of Jacks or better.

In order to maintain the interest of players, a wide variety of game options have been presented. For example, in some games the amount which may be wagered or paid out varies. In other games, the hands which comprise predetermined winning hands varies.

One video poker game variation which is currently popular is known as TRIPLE PLAY™. In accordance with one arrangement of this game as disclosed in U.S. Pat. No. 5,823,873, a player is dealt a hand of cards. The player elects which of the cards in that first hand to hold. The cards held in the first hand are then duplicated to other hands, the number of additional hands depending generally on the amount bet by the player. This forms a number of hands each containing the exact same cards. The non-held cards in the first hand are then replaced to form a new first hand, and cards are added to the additional hands to complete those hands. The poker rank of each hand is then determined.

This poker game variation offers players the chance to increase the excitement of play by playing several hands of cards at the same time. On the other hand, a disadvantage of the game is that the cards which form the base or initial set of cards of each of the hands is always the same: the cards which were held from the first hand. Thus, the player in essence plays two or more of the same base hand and simply attempts to obtain additional cards which will make one of those base hands a winner.

It is desired to provide a game of poker which offers players the excitement of playing more than one hand of cards simultaneously, with greater excitement than present games.

SUMMARY OF THE INVENTION

The present invention comprise a method of playing a game. In one embodiment, the game is a poker-type game which involves the play of more than one hand of cards.

In one embodiment, the game includes the step of dealing a first hand of a predetermined plurality of cards. In one embodiment, five cards are dealt. Next, cards are selected from the first hand to be used in a second hand. In one embodiment, the selected cards are duplicated into the second hand. Cards are then selected to be held in the first hand. The non-held cards from the first hand are discarded. The discarded cards in the first hand are then replaced to complete the first hand. Cards are also added, as necessary, to the second hand to complete the second hand of a predetermined plurality of cards. In one embodiment, the second hand also has five cards. In one embodiment, the outcome of the game is determined by comparing the first and second hands to predetermined combinations of winning cards.

In one embodiment, none, one or more, or all of the cards of the first hand may be used in the second hand, and none, one or more, or all of the cards in the first hand may be held. The cards which are selected for use/duplication and the cards which are held may be different.

In one embodiment, a number of additional hands of cards other than the first hand may be played. The player is allowed to select none, one or more, or all of the cards from the first hand to be duplicated into each additional hand. The cards which are duplicated into the additional hands may be different from one another.

In one embodiment, the game may be implemented on a computing device and a computer may select the cards to be duplicated and the cards to be held.

In one embodiment, a player is required to place a wager for each hand to be played. Winnings may be paid based on the amount wagered. Greater winnings may be paid for higher ranked hands.

In another embodiment, the player is permitted to play a plurality of hands based on a single wager. In this embodiment, the payout for receiving a winning hand in other than the first hand and/or the criteria for determining if a winning hand is received in other than the first hand may be varied.

Further objects, features, and advantages of the present invention over the prior art will become apparent from the detailed description of the drawings which follows, when considered with the attached figures.

DESCRIPTION OF THE DRAWINGS

FIG. 2(*b*) illustrates an example of cards selected from the first hand illustrated in FIG. 2(*a*) for duplication into a second hand and the discarding of non-held cards in the first hand in accordance with steps of a method of the invention;

FIG. 2(*c*) illustrates resulting first and second hands after a replacement card has been dealt for the discarded card in the first hand and after additional cards have been dealt to complete the second hand of FIG. 2(*b*) in an example of steps of the method of the invention;

FIG. 3(*b*) illustrates resulting first, second and third hands after replacement and additional cards have been dealt to the hands illustrated in FIG. 3(*a*).

DETAILED DESCRIPTION OF THE INVENTION

The invention is a method of playing a game. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention comprises a method of playing a poker-type card game. In accordance with one embodiment of the invention, a first hand of cards is dealt. A player may select one or more of the cards from the first hand to be used in at least one second hand. Regardless of the cards selected to be used in the at least one second hand, the player may elect to hold/discard any of the cards from the first hand. The discarded cards are replaced in the first hand and additional cards are dealt to the at least one second hand for completing the first and second hands. The outcome of each hand is determined by comparing the hand to predetermined winning hands.

Figure 1:
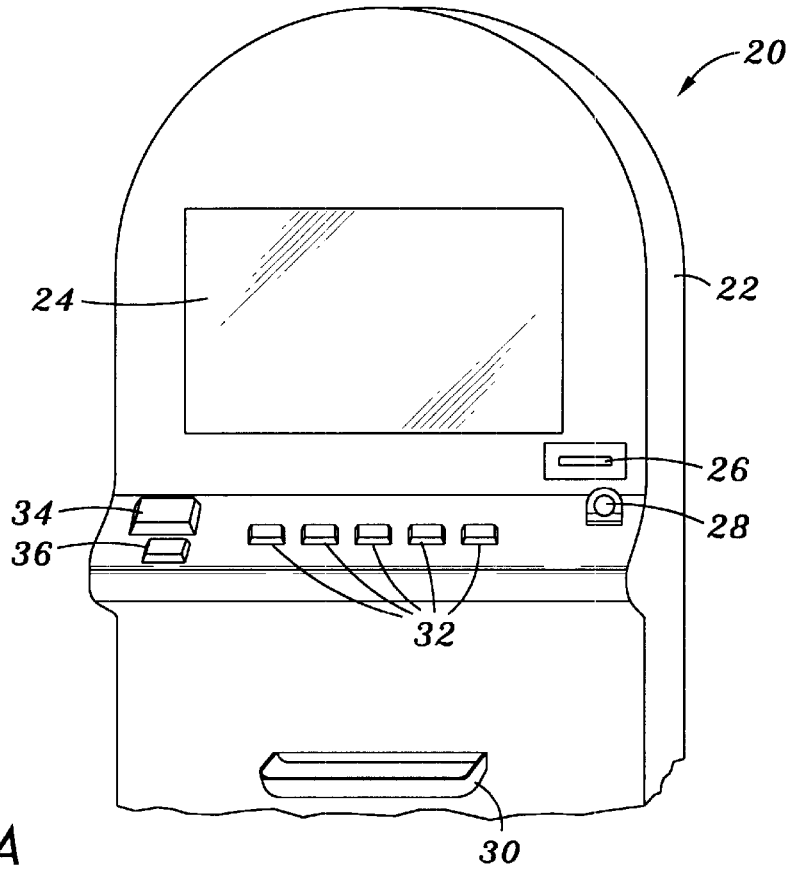
FIG. 1 illustrates a gaming device of the type which may be used to implement a game in accordance with the invention for play by a player.

In a preferred embodiment, the game is presented to a player with a gaming machine. FIG. 1 illustrates a gaming machine 20 in accordance with the invention. As illustrated, the gaming machine 20 includes a housing 22 for enclosing/supporting various components of the gaming machine. The gaming machine 20 includes a display 24 for displaying images of cards or other indicia. Speakers (not shown) or other devices may be provided for generating sound associated with the game.

In one embodiment, the game is played as a wager-type game which requires that a player place a bet or wager to play the game. Preferably, if the player is a winner of the game, then the player is provided an award, such as a monetary payout (such as coins) or other prizes. As illustrated, the gaming machine 20 may include a bill validator/acceptor 26 for accepting paper currency, and a coin acceptor 28 for accepting coins. Other means of payment, such as a credit card reader may be provided. An award of winnings in the form of coins may be paid to the player via a coin tray 30.

Preferably, the gaming machine 20 includes means for a player to provide input. In one embodiment, this means comprises one or more buttons. For example, a plurality of card "hold" or "select" buttons 32 may be provided for permitting a player to hold/select cards in a hand. A deal/draw button 34 permits a player to indicate that they wish the game to start or to draw replacement cards. A bet button 36 is provided for a player to select the amount to bet on a particular game.

A game controller (not shown) is provided for controlling the various devices of the gaming machine and for providing game information. For example, the game controller may be arranged to generate video and audio data for presentation by the display and speakers of the gaming machine 20. The game controller may be arranged to detect a signal from the coin acceptor indicating the receipt of coins, and may be arranged to cause a coin delivery mechanism to deliver coins from a coin hopper to the coin tray 30.

It will be appreciated that the gaming machine 20 may have a variety of configurations and the gaming machine 20 illustrated and described above is but an example of a device for implementing the game of the present invention. In one or more embodiments, the gaming machine 20 may be associated with a network and receive game information remotely and may transmit information, such as payout and game play information, to a remote location.

One embodiment of a game in accordance with the present invention will be described with reference to FIGS. 2(*a*)–(*c*). In accordance with one method of playing a game, a first hand of cards 100 is dealt to a player. The cards may be dealt from a "deck" comprising a single deck of cards, or a plurality of decks of cards. In the preferred embodiment, the act of dealing comprises the generation of card information and the display of the card(s) to the player with the display. In this arrangement, the "deck" does not comprise a physical set of cards, but simply data regarding such cards.

In one embodiment, the first hand of cards 100 comprises five cards. Preferably, the cards are dealt face-up. In the example illustrated in FIG. 2(*a*), the player has been dealt the Jack of Hearts, Jack of Diamonds, Queen of Diamonds, King of Diamonds, and King of Hearts.

Next, a player is permitted to use none, one or more, or all, of the cards of the first hand of cards 100 in a second hand of cards 200. Referring to FIG. 2(*a*), when the first hand of cards 100 is dealt, spots or spaces for the cards of the second hand of cards 200 may be illustrated. In one embodiment, the second hand of cards 200 will comprise five cards. The selected cards from the first hand of cards 100 are displayed in the second hand of cards 200. In one embodiment, the card positions of the first and second hand of cards 100, 200 are aligned in vertical columns. The selected cards from the first hand of cards 100 are duplicated or re-used (such as by displaying) in corresponding card positions of the second hand of cards 200. In other embodiments, the card positions need not align, and the cards which are duplicated or re-used need not be provided in matching or similar card positions. As illustrated in FIG. 2(*a*), the player has selected the Jack of Diamonds, Queen of Diamonds and King of Diamonds.

It will be understood that by the terms duplicating or re-using it is meant that the same card having the same rank/value and the like is associated with the second (or other additional) hand. In one embodiment, the card need not be "duplicated" in the sense that it is reproduced, although this is the most convenient method of illustrating to the player the association of that particular card with a hand. For example, the hands need not be displayed simultaneously, in which event, the duplicated card is not visually duplicated.

The player is also permitted to hold none, one or more, or all, of the cards of the first hand of cards 100. The held cards may be entirely different from the cards which were duplicated or reused in the second hand of cards 200. As illustrated, the player has selected to hold the Jack of Hearts, Jack of Diamonds, the King of Diamonds, and the King of Hearts. The player has elected to discard the Queen of Diamonds.

Next, any non-held cards from the first hand of cards 100 are discarded and replaced. Any cards needed to complete the second hand of cards 200 are dealt or added to the second hand of cards 200. In the example illustrated, a single card is necessary to replace the discarded Queen of Diamonds in the first hand of cards 100. In addition, two cards are necessary to complete the second hand of cards 200. In one embodiment, the cards which are dealt in this step are from the same deck of cards from which the cards were dealt to the first hand of cards 100.

In the example illustrated, a King of Clubs has been dealt to the first hand of cards 100 to replace the discarded Queen of Diamonds. A Ten of Diamonds and an Ace of Diamonds have been dealt to the second hand of cards 200 to complete this hand.

Next, it is determined if the player is a winner of the game. Preferably, each hand of cards is evaluated against a one or more winning hands or combinations of cards. If either or both hands of cards comprises a predetermined winning hand of cards, then the player is declared a winner. The combinations of cards comprising predetermined winning hands of cards may be varied. The predetermined winning hands may comprise one or more of the well-known card combinations in poker, having the also well-known hand rankings. For example, in one embodiment, a hand of cards having a ranking greater than a pair of Jacks may be declared a winning hand. In another embodiment, at least two pair may be required to obtain a winning hand.

Figure 2A:
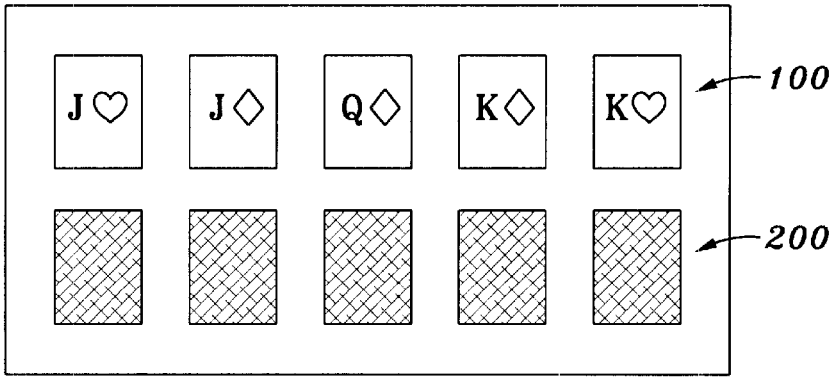
FIG. 2(*a*) illustrates a first hand of cards dealt in accordance with an example of a step of a method of the invention.
Figure 2B:
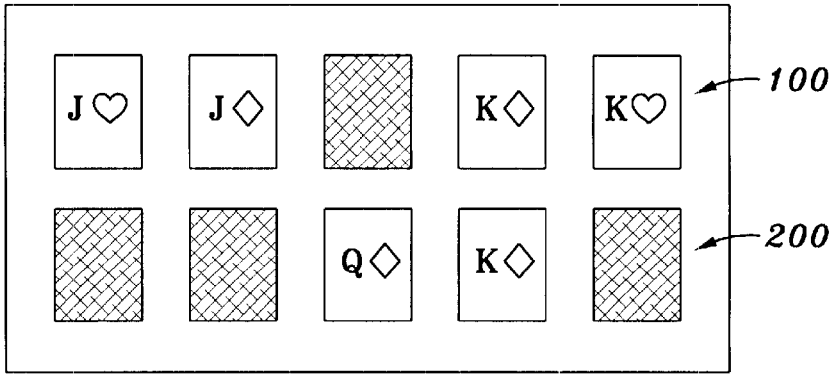
Figure 2C:
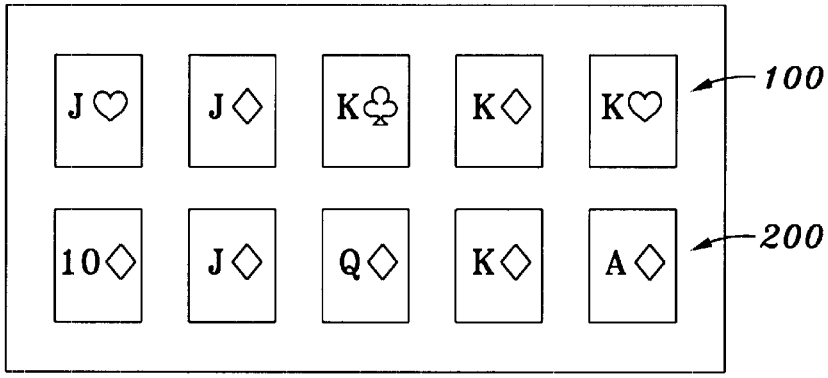

In the example illustrated in FIG. 2(*c*), the player's first hand of cards 100 and second hand of cards 200 may comprise a winning hand. The resulting first hand of cards 100 comprises a Full House (three Kings and two Jacks). The resulting second hand of cards 200 comprises a Royal Flush (Ten, Jack, Queen, King and Ace of the same suit).

If a hand comprises a predetermined winning hand, the player may be awarded a payout or winning. The amount of the winning or size of the prize may vary depending upon a number of criteria. A player may be awarded a larger prize or winning for placing a larger bet. A player may also be awarded a larger prize or winning for a higher ranked winning hand.

Many unique and exciting aspects of the game will now be appreciated. First, a game is provided which comprises the generally simultaneous play of at least two hands of cards, and which also provides the opportunity for more than one winning event.

Second, a game is provided which allows a player to select cards from a first hand of cards to be used in a second hand of cards. Moreover, the selected cards need not be the same as those the player ultimately elects to play in the first hand of cards. This has several advantages. A player may form a particular strategy for attempting to form winning hands by varying the cards which are used in the first and second hands. For example, in the embodiment illustrated in FIGS. 2(*a*)–(*c*), the player elected to try for a Royal Flush in the second hand of cards, and a Full House in the first hand of cards. In this manner, the player attempted to try for a low percentage hand (Royal Flush), and a higher percentage odds hand (Full House). It will be appreciated that the ability to hold/select different cards for the first and second hands also allows a player to avoid trying to receive the same combination of cards in both hands, when once the cards are dealt and the winning hand is received in one hand, the other hand can not be the same. For example, if the player elected to use the Jack, Queen and King of Diamonds in both hands illustrated in FIG. 2(*b*), then after the cards are dealt, both hands can not result in a Royal Flush, since only a single Ace and Ten of Diamonds remain (when using a single deck of cards). The remaining cards dealt to the other hand would then not result in the other hand comprising a Royal Flush.

In accordance with the present invention, the player is provided with an opportunity to see five of the cards of the deck and select particular cards to use in a second hand and to hold in a first hand to generate a plurality of optimized winning possibilities.

Figure 3A:
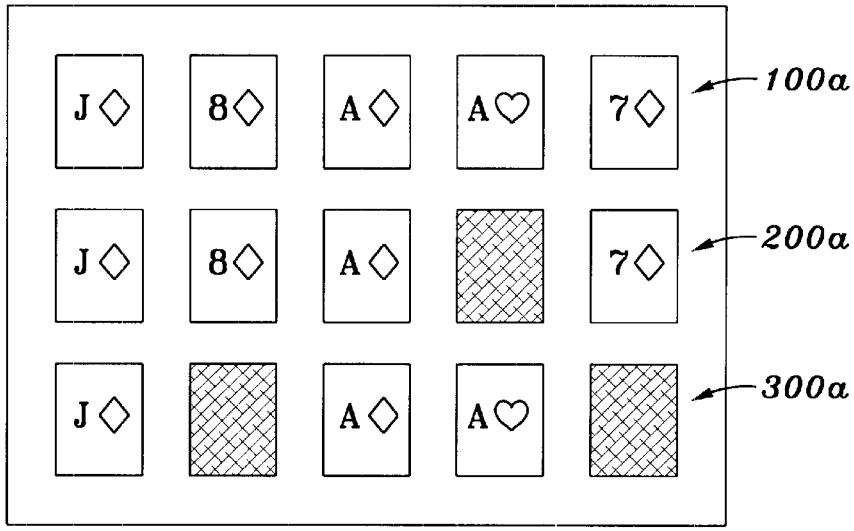
FIG. 3(*a*) illustrates a dealt first hand of cards and a second and third hand of cards into which cards from the first hand have been duplicated in an example of a method of the invention.
Figure 3B:
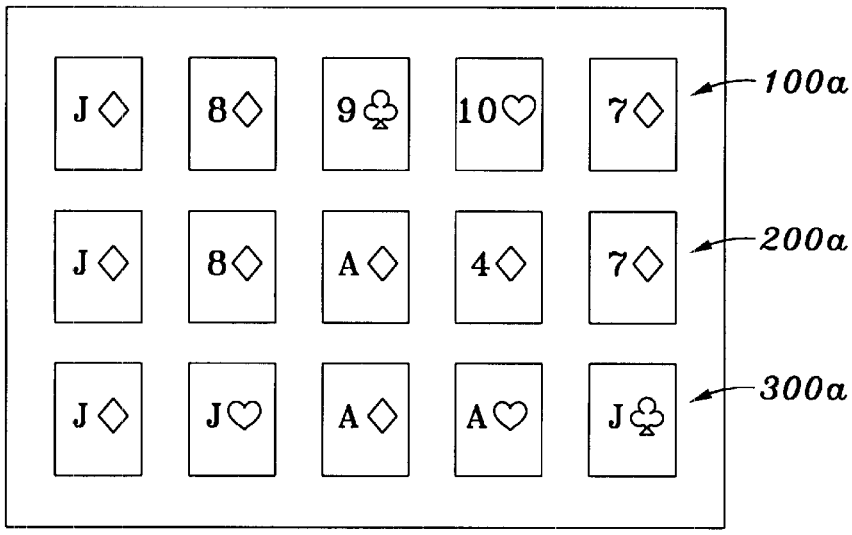

The method of the invention may be extended to the play of more than one hand of cards in addition to the first hand. FIG. 3 illustrates such an example of this embodiment of the game. As illustrated, the game includes three hands of cards, a first hand of cards 100*a*, a second hand of cards 200*a*, and a third hand of cards 300*a*.

The method of game play is similar to that described above, except that the player is permitted to select none, one or more, or all, of the cards from the first hand of cards 100*a* to be used in the second hand of cards 200*a*. The player is also permitted to select none, one or more, or all of the cards from the first hand of cards 100*a* to be used in the third hand of cards 300*a*. The cards which are selected to be used in the second hand of cards 200*a* need not be the same as the cards which are selected to be used in the third hand of cards 300*a*. Further, the cards which the player elects to hold in the first hand of cards 100*a* need not be the same as the cards selected to be used in either or both of the second and third hands of cards 200*a*, 300*a*.

In the example illustrated, the player has been dealt a first hand of cards 100*a* comprising a Jack of Diamonds, Eight of Diamonds, Ace of Diamonds, Ace of Hearts, and Seven of Diamonds. The player has selected the Diamonds cards (the Jack, Eight, Ace and Seven of Diamonds) to be reused in the second hand of cards 200*a*. The player has selected the Jack of Diamonds, Ace of Diamonds and Ace of Hearts to be used in the third hand of cards 300*a*. The player may elect to hold none, one or more, or all of the cards from the first hand of cards 100*a*. Referring to FIG. 3(*b*), the player elected to hold the Seven, Eight and Jack of Diamonds.

An example of the resulting hands after replacement cards have been dealt to the first hand of cards 100*a* and additional cards have been dealt to the second and third hand of cards 200*a*, 300*a* is illustrated in FIG. 3(*c*). As illustrated, the first hand of cards 100*a* resulted in a straight (Seven, Eight, Nine, Ten and Jack). The second hand of cards 200*a* resulted in a Flush (all cards of the suit of Diamonds). The third hand of cards 300*a* resulted in a Full House (a pair of Aces and three Jacks).

It will be appreciated that the principles of the invention may be applied to games including more than three hands of cards.

In one or more embodiments, the number of hands which a player is permitted to play may be dependent upon the size of bet or wager. As an example, a player may be required to place a first bet amount to play a game including two hands of cards. The player may be required to place a second, larger bet to play a game including three hands of cards.

In another embodiment of the invention when the game is presented on a gaming machine including a controller/computer, the computer may automatically select none, one or more cards from the first hand to be duplicated into the second hand (and cards to be duplicated into other hands, such as a third hand, a fourth hand or the like if additional hands are being played). The computer also selects the none, one or more cards from the first hand which are to be held. Replacement cards are then dealt in place of discarded cards in the first hand and additional cards are dealt as necessary to fill the second or other additional hands. In this embodiment, the method of play is generally the same, except that the selection of cards to be duplicated and cards to be held is automated and performed by the computer instead of the player. In this embodiment, the computer may be programmed to select cards in a variety of fashions, including based upon odds of receiving hands, payouts for winning hands, or other criteria.

In another embodiment of the invention, a player may not be required to place a bet to participate in the play of hands other than the first hand. However, the payout for receiving a winning hand in other than the first hand and/or the criteria for determining if a winning hand is received in other than the first hand may be varied.

In one embodiment, a player is only required to place a single bet, but may participate in more than one hand, such as two or three hands as desired. In such event, the play of the hands is as described above. However, the determination of whether a winning hand has been received differs. If the player receives a predetermined winning hand in the first hand, i.e. the hand which the player paid to play, then the player is paid an award in the normal fashion. Any additional hands other than the first hand are not deemed to comprise a winning hand unless the hand is a predetermined winning hand and has a ranking greater than the ranking of any cards which were duplicated in to that hand from the first hand.

As an example, the player may be dealt a first hand comprising Ace, Ace, Seven, Eight, King. The player may elect to duplicate the two Aces into the second hand. After additional cards are dealt to the player, the resulting second hand may comprise Ace, Ace, Two, Three, Jack, or a hand rank of a pair of Aces. However, this pair of Aces was received by duplication from cards of the first hand, and therefore the second hand is not deemed a winning hand. On the other hand, after additional cards are dealt to the player, the resulting second hand may comprise Ace, Ace, Jack, Jack, Jack, or a Full House. In such event, the resulting hand is greater in rank than the rank of any hand which could be formed from the cards which were duplicated (i.e. a Full House has a greater rank than a pair of Aces). Therefore, the second hand is deemed a winning hand.

In a preferred arrangement of this embodiment, when the player receives a winning hand in other than the first hand, the player is paid a winning which is reduced in comparison to a winning which is paid for a hand of the same rank when received when the player has placed a bet to play the additional hand. For example, in one embodiment, a player may be paid a winning amount of 100 coins for receiving a Four of a Kind in other than the first hand when the player has placed a single coin bet on that additional hand. In the embodiment where the player has placed a bet on only the first hand and receives a Four of a Kind winning hand in the second hand (i.e. not simply as a result of card duplication from the first hand), the player may only be paid 50 coins.

In another embodiment, when the player has not placed a bet on the additional hand, the combination of cards or the hands which are deemed to comprise predetermined winning combinations may comprise fewer combinations of cards. For example, when a player has placed a bet on a hand, a hand having a rank as low as a pair of Jacks may be deemed a winning hand. In the event a player has not placed a bet, a winning hand may only be a hand having a rank of two pair or greater.

In one or more embodiments of the invention, the first and/or additional hands may comprise other than five cards. For example, the first hand may comprise seven cards and the other hands five cards. This provides a player with a greater number of cards to select from for duplication into other hands. The outcome of the first hand may be based upon the best five card hand.

In one embodiment, there may be no "draw" on the first hand. For example, after the player has selected cards for duplication to the additional hands, cards are added to those hand(s). The outcome of the first hand is the best five card hand as originally dealt.

In one embodiment, cards may be dealt face-down and then turned over instead of being dealt face-up.

In one embodiment, one or more cards may be pre-dealt to the second or other additional hands. The player may then select the cards from the first hand which, when used with the pre-dealt cards in the second hand, form the best second hand.

In one or more embodiments, indicia other than cards may be used in the play of the game. For example, a variety of symbols may be used. In that event, the outcome of each "hand" or combination of symbols may be made by comparison to combinations of symbols which are deemed winning combinations.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A method of playing a game comprising:

dealing a first hand of a predetermined plurality of cards;

selecting cards from said first hand to be used in a second hand;

duplicating any selected cards into said second hand;

selecting from said plurality of cards dealt to said first hand cards to be held from said first hand;

discarding cards from said first hand which are not held;

replacing the discarded cards in said first hand to complete said first hand;

adding cards to said second hand to complete said second hand of a predetermined plurality of cards; and determining if said first or second hands comprise a predetermined combination of winning cards.

2. The method in accordance with claim 1 wherein said first and second hands each have five cards.

3. The method in accordance with claim 1 including the step of placing a first wager associated with said first hand and a second wager associated with said second hand.

4. The method in accordance with claim 1 including the step of placing a wager.

5. The method in accordance with claim 4 including the step of paying an award if said first or second hand comprises a predetermined combination of winning cards.

6. The method in accordance with claim 4 including the step of paying a first winning amount for a predetermined winning combination received in a hand on which a wager was placed and paying a second winning amount for said predetermined winning combination received in a hand on which a wager was not placed.

7. The method in accordance with claim 6 wherein said second winning amount is less than said first winning amount.

8. A method of playing a game comprising the steps:

placing a wager;

dealing a first hand of a plurality of cards;

selecting cards from said first hand to be used in at least one additional hand;

duplicating any selected cards into said at least one additional hand;

selecting from said plurality of cards dealt to said first hand cards to be held from said first hand;

discarding cards which are not held from said first hand;

replacing discarded cards in first hand to complete said first hand;

adding cards to said at least one additional hand to complete said at least one additional hand; and determining if said first or at least one additional hand comprises a predetermined combination of winning cards.

9. The method in accordance with claim 8 including the step of paying an award or winning for a predetermined combination of winning cards.

10. The method in accordance with claim 9 wherein said at least one additional hand comprises a second hand and a third hand.

11. The method in accordance with claim 9 wherein said first hand and said at least one additional hand comprise five cards.

12. The method in accordance with claim 9 wherein none, one or more or all of the cards from said first hand are held.

13. The method in accordance with claim 9 wherein none, one or more or all of the cards from said first hand are selected to be duplicated into said at least one additional hand.

14. A method of playing a game comprising the steps:

dealing a first hand comprising five cards;

selecting none, one or more or all of said cards from said first hand to be used in at least one additional hand;

duplicating said one or more selected cards into said at least one additional hand;

selecting none, one or more or all of said cards dealt to said first hand to be held from said first hand;

discarding cards which are not held from said first hand;

replacing discarded cards in said first hand to complete said first hand;

adding cards to said at least one additional hand to complete said at least one additional hand comprising five cards; and determining a poker hand ranking of said first hand and at least one additional hand.

15. The method in accordance with claim 14 including the step of placing a wager.

16. The method in accordance with claim 14 wherein said cards of said fist hand are dealt face up.

17. The method in accordance with claim 14 wherein said dealt, replacing and added cards are from a single deck of cards.

18. The method in accordance with claim 14 wherein said step or selecting none, one or more or all of said cards from said firsthand to be used in at least one additional hand comprises the steps of selecting none, one or more or all of said cards from said first hand to be used in a second hand and selecting none, or more or all of said cards from said first hand to be used in a third hand, and said step of adding cards comprises the steps of adding cards to said second hand to complete said second hand and adding cards to said third hand to complete said third hand.

* * * * *